US008708182B2

(12) United States Patent
Tilton et al.

(10) Patent No.: US 8,708,182 B2
(45) Date of Patent: Apr. 29, 2014

(54) METHOD AND CONTAINER LID TO MANIPULATE A CONTAINER OPENING LINER

(75) Inventors: Andrew T. Tilton, Chicago, IL (US); Lanny D. Baker, Longview, TX (US); Carl Feducia, Shreveport, LA (US); Michael J. Ryan, Chicago, IL (US); James A. Whisenhunt, Independence, MO (US)

(73) Assignee: Kraft Foods Group Brands LLC, Northfield, IL (US)

( * ) Notice: Subject to any disclaimer, the term of this patent is extended or adjusted under 35 U.S.C. 154(b) by 515 days.

(21) Appl. No.: 12/510,058

(22) Filed: Jul. 27, 2009

(65) Prior Publication Data

US 2011/0017739 A1 Jan. 27, 2011

(51) Int. Cl.
*B65D 51/20* (2006.01)
*B65D 53/04* (2006.01)

(52) U.S. Cl.
USPC ..... 220/258.3; 215/350; 220/304

(58) Field of Classification Search
USPC ..... 220/258.3, 304; 215/350, 351, 349
See application file for complete search history.

(56) References Cited

U.S. PATENT DOCUMENTS

| | | | | |
|---|---|---|---|---|
| 4,462,502 | A * | 7/1984 | Luenser et al. | 215/329 |
| 4,531,649 | A * | 7/1985 | Shull | 215/232 |
| 5,285,913 | A * | 2/1994 | Morton | 215/349 |
| 5,887,738 | A * | 3/1999 | Bietzer et al. | 215/232 |
| 6,477,823 | B1 * | 11/2002 | Kitterman et al. | 53/485 |
| 6,502,710 | B1 * | 1/2003 | Bosl et al. | 215/351 |
| 6,783,015 | B1 * | 8/2004 | Bosl et al. | 215/349 |
| 7,168,581 | B2 * | 1/2007 | Robinson et al. | 215/349 |
| 7,175,039 | B2 * | 2/2007 | German et al. | 215/252 |
| 7,380,678 | B1 * | 6/2008 | Johnsen | 215/277 |
| 7,784,629 | B2 * | 8/2010 | German et al. | 215/276 |
| 2002/0144971 | A1 * | 10/2002 | Nilstoft et al. | 215/350 |
| 2007/0095782 | A1 * | 5/2007 | Granger et al. | 215/351 |

* cited by examiner

*Primary Examiner* — Mickey Yu
*Assistant Examiner* — Niki Eloshway
(74) *Attorney, Agent, or Firm* — Fitch, Even, Tabin & Flannery LLP

(57) ABSTRACT

A container includes a body forming an interior and having a sidewall with a distal edge portion forming an opening to the interior. A liner is disposed over the opening and includes an inner portion and an outermost radial portion disposed radially outwardly of the distal edge portion. A lid including an interior surface and at least one tab projecting inward from the interior surface is disposed over the liner and engages the body. The liner is sized to be releasably rotatably secured within the lid while the lid is initially attached to the body so that the at least one tab remains generally rotationally fixed relative to the outermost radial portion while being assembled to the body. The at least one tab is arrange to press the outermost radial portion while the lid is being removed from the body so that the outermost radial portion maintains a bent orientation.

23 Claims, 4 Drawing Sheets

METHOD AND CONTAINER LID TO MANIPULATE A CONTAINER OPENING LINER

FIELD

The invention relates generally to containers with a lid and an opening covered by a liner, and more specifically to a container lid that shapes the liner.

BACKGROUND

A liner is often placed over a container opening to provide a seal. The seal between the liner and the container can be made by many suitable methods including a hot seal, a cold seal, and an induction seal. In the induction seal process, the lid is supplied with a liner already inserted into the lid. The liner is typically composed of a paper or foam layer bonded to a foil layer. A bottom layer under the foil is a polymer sealant. After the lid is attached to the container body, the container is passed under an induction coil. The induction coil heats the foil with an oscillating electromagnetic field, which in turn heats the liner to form a seal between the liner and the container body.

As a result of requiring the liner to stay within the lid prior to sealing, the liner must be larger than the opening by an acceptable tolerance. Also, the foam layer frequently shrinks due to the heating from the induction coil, which reveals a small edge of foil. Similarly, the paper layer commonly partially separates from the foil layer, which also reveals a small edge or portion of foil. Thus, when opening the container by first removing the lid from the container, a foil edge of the liner undesirably extends radially outward from the rim of the container. Accordingly, a method and apparatus is needed to manipulate the edge of the liner so that it no longer extends radially outward.

SUMMARY

A container that solves the problem mentioned above has a body which forms an interior and has a rim or sidewall with a distal edge portion that forms an opening to the interior. The container includes a liner disposed over the opening. The liner has an inner portion and an outermost radial portion which, when disposed over the opening, is disposed radially outwardly of the distal edge portion of the sidewall. The container further includes a lid disposed over the liner which engages the body. The lid includes an interior surface and at least one tab projecting inward from the interior surface. The liner is sized to be releasably rotatably secured within the lid while the lid and liner are initially attached to the body. While initially attaching the lid and liner to the body, the at least one tab remains generally rotationally fixed relative to the outermost radial portion of the liner. Then, when the lid is removed from the body, the tab is arranged to press the outermost radial portion of the liner so that the outermost radial portion maintains a bent orientation.

In one form, the tab presses an outermost radial portion of the liner so that the outermost radial portion remains bent, creased, and/or substantially flush with a side of the body.

One example method includes placing the liner within a lid that has the tab described above. The lid is then rotated onto a container to secure the lid to the container. While the lid is being rotated onto the container, the liner rotates with the lid. Since the tab on the lid is rotating with the liner, it merely causes an indent on the liner. Then, as the lid is rotated to remove the lid from the container, the tab moves circumferentially against the now stationary outer edge portion of the liner to bend it.

BRIEF DESCRIPTION OF THE DRAWINGS

The above needs are at least partially met through provision of the method and apparatus to manipulate a liner described in the following detailed description, particularly when studied in conjunction with the drawings, wherein.

Figure 1:
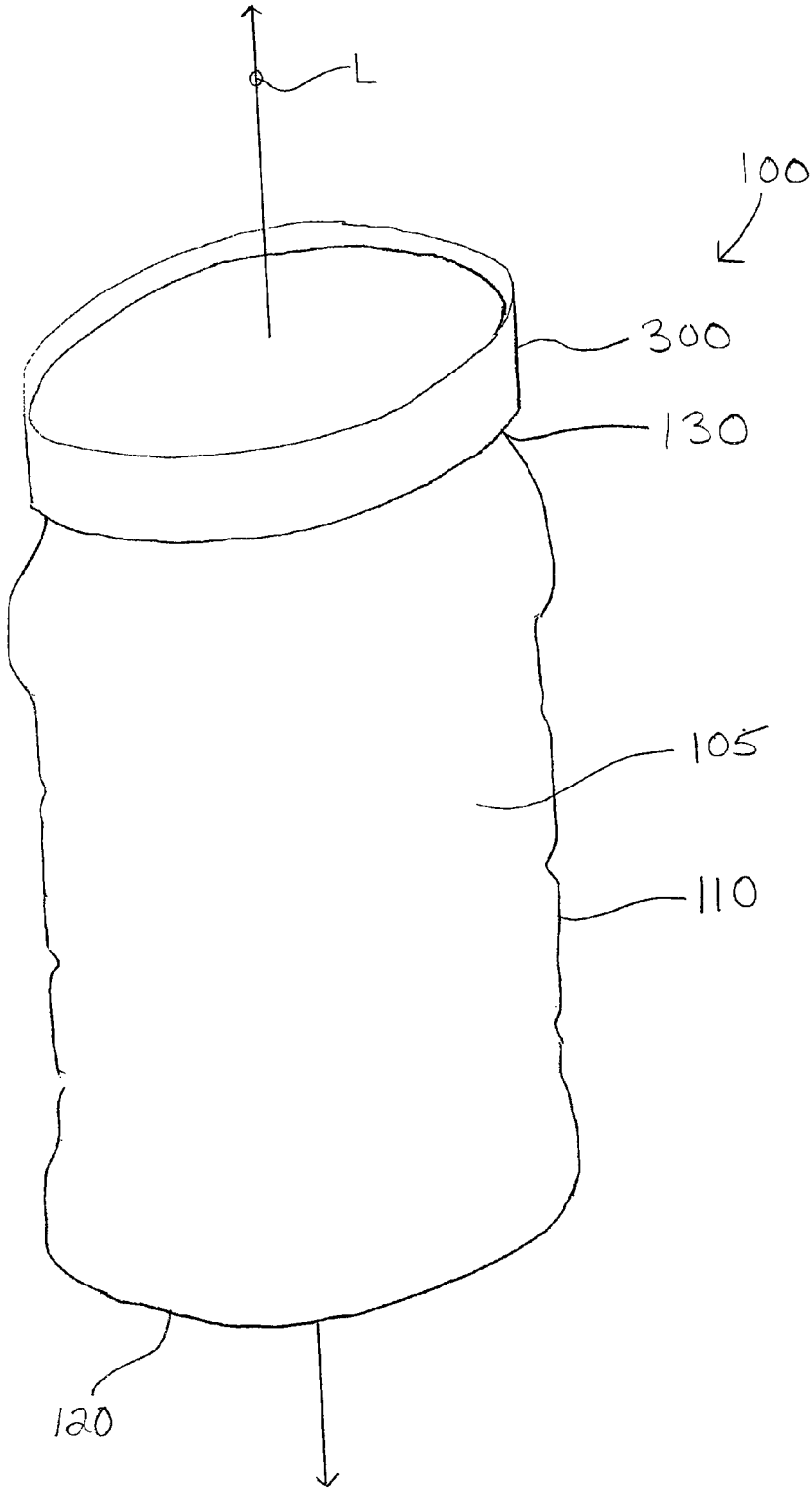
FIG. 1 comprises a side perspective view of a container as configured in accordance with various embodiments of the invention.
Figure 2:
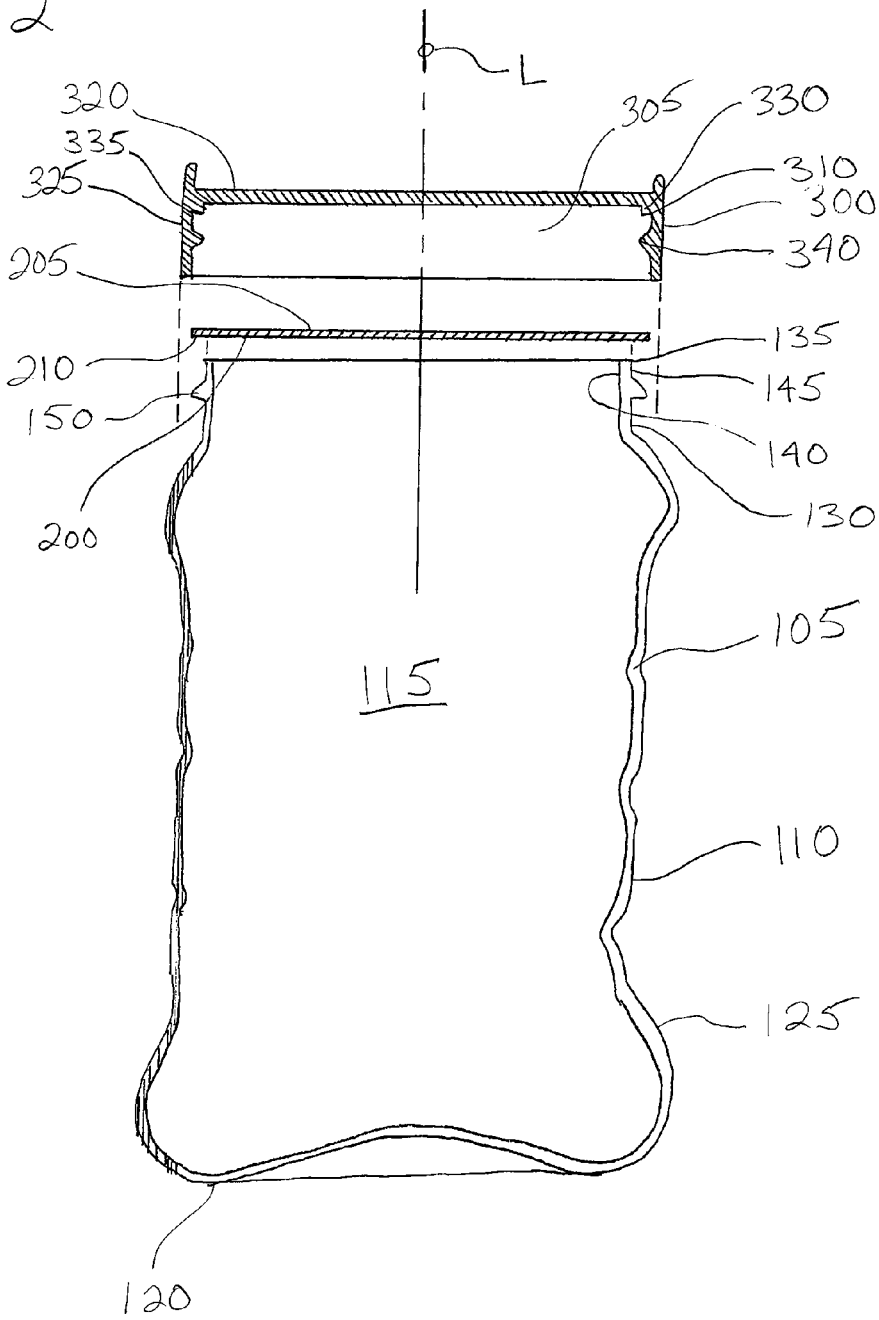
FIG. 2 comprises an exploded, side cross-sectional view of the container of FIG. 1.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Referring to FIGS. 1-4, a container 100 has a body 105 with a tubular sidewall 110 forming an interior 115. The body 105 includes an axis of rotation or longitudinal axis L that extends longitudinally through the body 105. The body 105 may be made of any suitable material, such as plastic or glass. By one approach, the body 105 may be made of polypropylene or polyethylene terephthalate.

A base 120 closes one end portion 125 of the body 105. The sidewall 110 extends to an opposite end portion 130 of the body 105 and includes a rim or distal edge portion 135 that forms an opening 140 to the interior 115. The distal edge portion 135 includes an annular outer surface 145. The body 105 can be used to store any type of contents, including organic, plastic, metal, or any combination thereof. By the illustrated approach, the opening 140 is relatively large so that the body 105 can be used to store an edible product, such as ground coffee, soluble coffee, mayonnaise, or peanut butter. It will be appreciated, however, that the opening 140 and the body 105 can be shaped to hold a wider variety of liquid or solid materials, whether edible or not.

The container 100 further includes a liner 200. The liner 200 is disposed over the opening 140 to seal the interior 115 of the body 105. The type of liner used depends on the type of seal being made. If, for example, the liner 200 is adhered to the container 100 with an induction seal, the liner 200 may include, for example, paper and foil layers or foam and foil layers.

The liner 200 includes an inner portion 205 and an outermost radial portion 210 that extends radially outwardly of the distal edge portion 135 when the liner 200 is assembled on the body 105. By one approach, the outermost radial portion 210 is initially unbent.

The container 100 further includes a lid 300. The lid 300 is disposed over the liner 200 and engages the body 105. The lid 300 can initially engage the body 105 by any suitable method, such as by threading 150 (as illustrated here), snap-fit, tongue and groove, or by another securing mechanism as long as the lid 300 is rotated to remove it from the body 105. The lid 300 attaches to the body 105 to close off and protect the opening 140, and secure any contents within the body 105. The lid 300 also may be made of any suitable material, such as, for example, polypropylene and polyethylene terephthalate.

In one example form, the lid 300 includes an interior surface 305 and at least one swipe or tab 310 projecting inward from the interior surface 305. In one form, the lid 300 includes one to ten tabs 310, and in another form six tabs 310, where the number of tabs 310 is dependent on the size of the body 105. In one form, the tabs 310 include an outer surface 315 that extends generally parallel with the axis L. In one form, the outer surface 315 slants radially inward relative to the axis L or vertical, such as by an angle $\alpha$, in the range of 0.1 to 1.0 degrees. In the illustrated form, the outer surface 315 is angled inwardly at about 0.5 degrees. Vertically slanting the outer surface 315 provides better clearance for the lid 300 to lift directly off of a mold in which the lid is formed and which has a corresponding slanted surface forming the outer surface 315. Otherwise, the lid 300 may scrape or scar a more vertical surface of the mold as the lid 300 is being moved from the mold.

Figure 4:
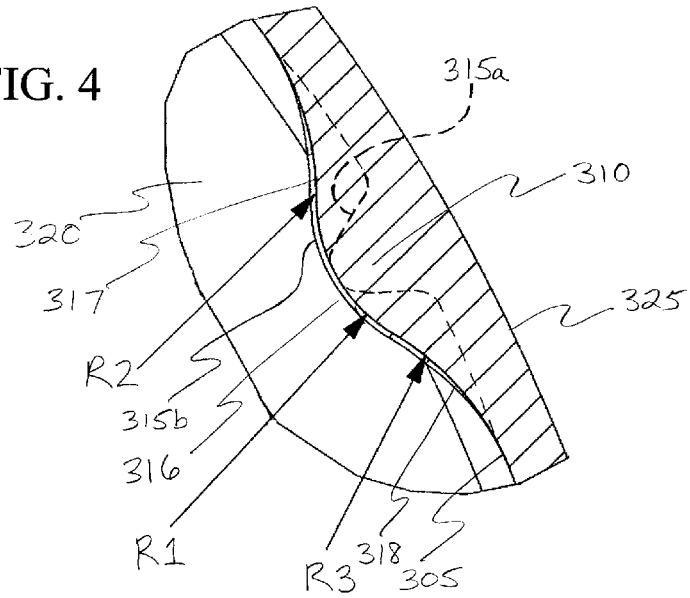
FIG. 4 comprises a close-up, cross-sectional lower view of a lid for the container of FIG. 1.

From an upper or lower view, the outer surface 315 may be generally triangular or may have a more rounded u-shaped surface 315*a* with diverging sides to form a rounded peak, as shown in dash-line (FIG. 4). By this approach, in the illustrated form, the outer surface 315 has a longitudinal height of about 0.07 inches.

By another approach, an outer surface 315*b* has a more gentle curve extending radially inward to form a hill-shape. The outer surface 315*b* has a convex center circular segment 316 with a radius R1 forming a rounded peak circumferentially between two outer concave circular segments 317, 318 with radii R2 and R3 respectively. In the illustrated form, the center segment 316 has a radius R1 of approximately 0.137 inches, while the outer segments have a radius R2 or R3 of approximately 0.250 inches. In this case, the outer surface 315 has a longitudinal height of about 0.06 inches. The outer surface 315*b* results in less abrasion to the liner 200 when the lid 300 is removed from the body 105 than the surface 315*a*.

The tabs 310 further include a bottom surface 319*a*. The bottom surface 319*a* extends generally radially outward from, and transversely to, the outer surface 315. The bottom surface 319*a* also extends transversely to axis L. While a bottom surface 319*b* may extend perpendicular to the axis L (shown in dash-line), the bottom surface 319*a* is slanted downwardly from horizontal, such as by an angle $\beta$, as it extends radially outwardly. In one form, angle $\beta$ is in the range of 10 to 30 degrees. In the illustrated form, the bottom surface 319*a* extends at an angle of 20 degrees. A bottom angle of 20 degrees provides the tab 310 with sufficient clearance to rotate without undesirably engaging the top thread 150. The 20 degree angle factors in a vertical tolerance distance from the top rim 135 of the body 105 to the top thread 150, which in the illustrated form is +/−0.015 inches.

The slanted bottom surface 319*a* also facilitates securing the lid 300 to the body 105 when the lid 300 is applied using equipment in a commercial process. Specifically, the slanted bottom surface 319*a* better locates the lid 300 on the container body 105 by reducing the chances the tab 310 will rest on top of the rim 135 of the body 105 rather than securing radially adjacent to the body 105.

The lid 300 may further include a cover portion 320 and an annular wall 325 extending axially away from the cover portion 320. In the illustrated form, interior threads 340 on the annular wall 325 engage the threads 150 on the outer surface 145 of the body 105.

In the illustrated example, the annular wall 325 and/or the cover portion 320 form the interior surface 305. Here, the tabs 310 protrude interiorly from both the cover portion 320 and the annular wall 325. Specifically, the cover portion 320 and the annular wall 325 form a joint 330 and the tabs 310 protrude inwardly from the joint 330 and above the threads 340. Thus, the tabs 310 protrude radially inward from the annular wall 325 and downward from the cover portion 320. It will be appreciated, however, that the tabs 310 could alternatively extend solely from either the cover portion 320 or the annular wall 325.

Figure 5:
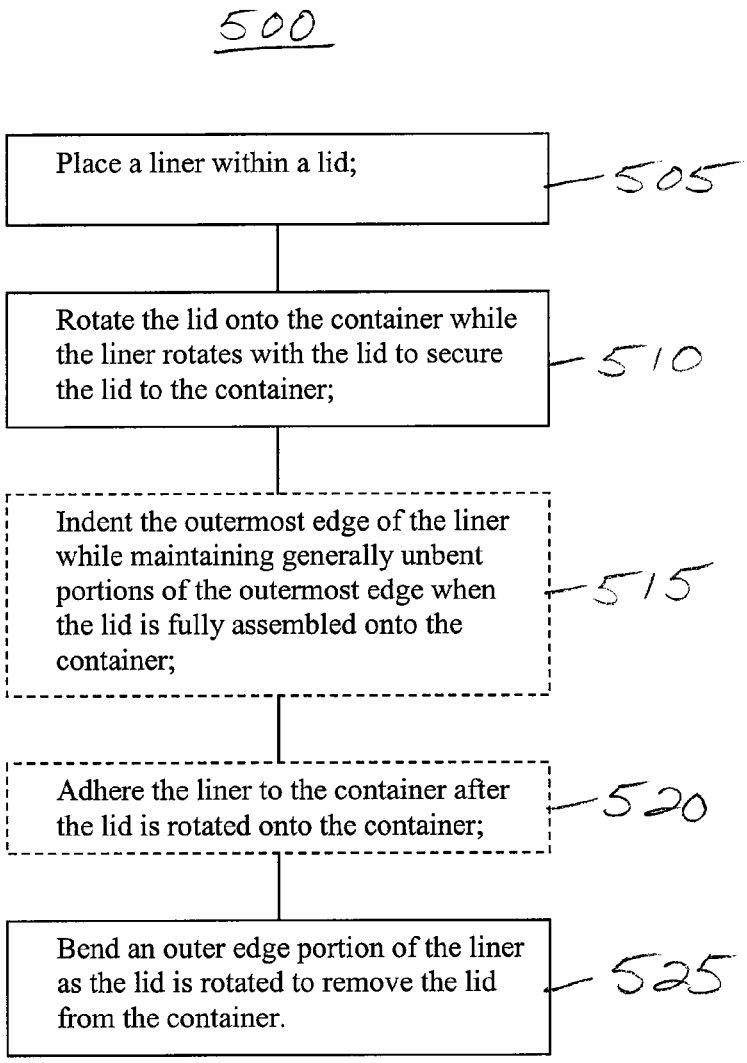
FIG. 5 comprises a flow-chart showing a process for various embodiments of the container of FIG. 1.

Referring to FIG. 5, a process 500 for manipulating a liner 200 includes the following. The liner 200 may be sized to be releasably rotatably placed or secured 505 within the lid 300 prior to the lid 300 being secured to the body 105. When the lid 300 and liner 200 are initially attached to the body 105, the liner 200 is disposed between the lid 300 and the body 105. The lid 300 is then rotated to the body 105 without the tabs 310 engaging substantial portions of the outermost radial portion 210 because the liner 200 rotates 510 with the lid 300 as the lid 300 is threaded to the body 105. The tabs 310 remain generally rotationally fixed relative to the liner 200. When the liner 200 is squeezed between the body 105 and the lid 300, each tab 310 will cause an indent 515 in the liner 200 at or near the location of the tab 310. Because the tabs 310 are relatively small, this maintains substantial unbent portions of the outermost radial portion 230.

In one form, at least a majority of the circumference of the outermost radial portion 210 remains unbent, and in another form approximately 95% or more of the circumference of the outermost radial portion 210 remains unbent (this is roughly the circumferential distance minus the total circumferential distance of the tabs 310 in the illustrated example). Once the lid 300 is secured onto the body 105, the liner 200 is adhered 520 to the container 100 if desired, such as by an induction coil. The tabs 310 are arranged to press and bend 525 the outermost radial portion 210 of the liner 200 while the lid 300 is being removed from the body 105 so that the outermost radial portion 210 maintains a bent orientation. Specifically, while the lid 300 is being unthreaded from the body 105, the tabs 310 are arranged to press the outermost radial portion 210 of the liner 200 against the sidewall 110 of the body 105 as the tabs 310 rotate with the lid 300. In one form, the tabs 310 are arranged to press the unbent portions of the outermost radial portion 210 of the liner 200.

Alternatively, if a conduction sealing process is utilized, the liner 200 is secured to the body 105 prior to the lid 300 being secured to the body 105. The conduction sealing process heats the liner 200, forming a hot seal between the liner 200 and the body 105. By this approach, when the lid 300 is subsequently attached to the body 105, the tabs 310 would contact the outermost radial portion 210 of the liner 200 and press the outermost radial portion 210 against the sidewall 110 of the body 105, such as to leave the outermost radial portion 210 substantially flush with the sidewall 110.

Figure 3:
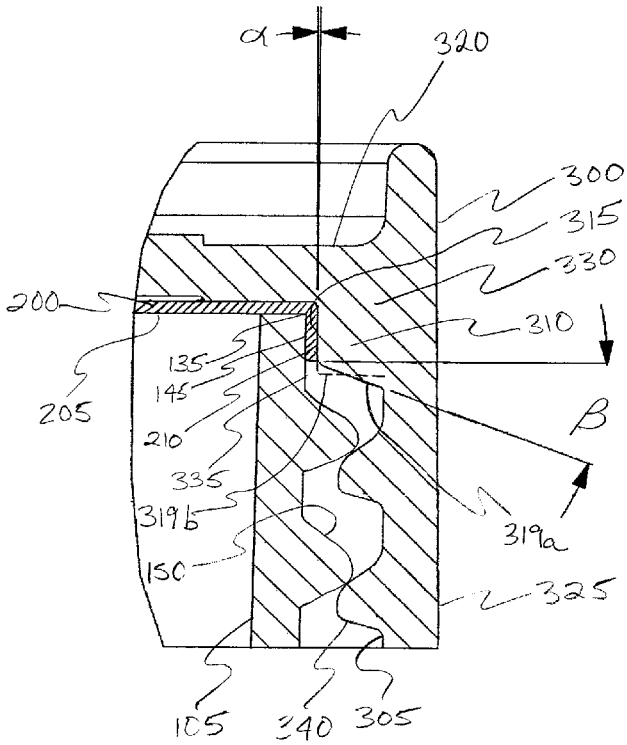
FIG. 3 comprises a close-up, fragmentary cross-sectional side view of the container of FIG. 1.

As the tab 310 rotates and engages the liner 200, the outermost radial portion 210 is forced downward between the tab 310 and the outer surface 145 of the sidewall 110, and below a lower, distal corner 335 of the tab 310 (as shown in FIG. 3). In one example, the outermost radial portion 210 is bent sufficiently for the outermost radial portion 210 to remain bent after the tab 310 is disengaged. In another form, the outermost radial portion 210 remains substantially flush with the sidewall 110 of the body 105 or extends parallel to the annular outer surface 215. The tabs 310 may even crease the liner 300 as the tabs 310 press the outermost radial portion 210. Creasing or bending the liner 220 may leave the outermost radial portion 230 of the liner 220 disposed generally parallel to the annular outer surface 215 after creasing or bending.

It will be appreciated that the lid 300 may be secured to the body 105 in ways other than rotation as long as the lid 300 is rotated when removing the lid 300 from the body 105. Thus, the lid 300 may be snap fit or initially loosely adhered to the body 105, but still threaded off of body 105, as mentioned above. In one example, removal threads on the body may have gaps to permit bypassing the threads to accommodate snapping on of the lid 300 and so forth.

It will be understood that the method described herein may be streamlined into a continuous method for a large production. For example, many lids, with the liner secured within them, may be attached to many bodies of containers during a production process, and then the assembled containers can pass under an induction coil to seal the liners to the bodies. These teachings may also be scaled to accommodate varying sizes of containers.

So configured, a container may be economically and efficiently sealed, secured, shipped, and offered to the consumer in packaging that manipulates the outer portions of the liner when the lid is being removed.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

What is claimed is:

1. A container comprising:
- a body forming an interior and having a sidewall with a distal edge portion forming an opening to the interior;
- a liner disposed over the opening and adhered to the distal edge portion of the sidewall, wherein the liner has an inner portion and an outermost radial portion disposed radially outwardly of the distal edge portion of the sidewall; and
- a lid disposed over the liner and engaging the body, the lid comprising:
  - an interior surface, and
  - two or more tabs projecting inward from the interior surface,
- wherein the liner is sized to be releasably rotatably secured within the lid while the lid and liner are initially attached to the body so that the tabs remain generally rotationally fixed relative to the outermost radial portion while being fully assembled to the body, and
- wherein tabs are arranged to press the outermost radial portion of the liner while the lid is being removed from the body so that the outermost radial portion maintains a bent orientation adjacent to the sidewall of the body.

2. The container of claim 1, wherein the tabs are arranged to press the outermost radial portion of the liner while the lid is being removed from the body so that the outermost radial portion remains substantially flush with the sidewall after the lid is removed.

3. The container of claim 1, wherein the tabs are arranged to press the outermost radial portion of the liner against the sidewall at the distal edge portion as the lid is unthreaded from the body.

4. The container of claim 1, wherein the tabs have a rounded peak in top view.

5. The container of claim 1, wherein the tabs comprise six circumferentially-spaced tabs.

6. The container of claim 1, wherein the tabs are configured to crease the liner as the tabs move circumferentially during removal of the lid by pressing the outermost radial portion of the liner.

7. The container of claim 6, wherein the sidewall has an annular outer surface, and wherein the outermost radial portion of the liner extends parallel to the outer surface after creasing and removal of the lid.

8. The container of claim 1 wherein the lid further comprises:
- a cover portion; and
- an annular wall generally extending axially away from the cover portion,
- wherein the tabs protrude interiorly from both the cover portion and the annular wall.

9. The container of claim 8 wherein the tabs comprise a top edge intersecting the cover portion, a free bottom edge, and a co-planar span therebetween.

10. The container of claim 1 wherein the liner has unengaged portions of the outermost radial portion after the lid is attached to the body, and the tabs are configured to press the unengaged portions of the liner while the lid is being removed from the body so that substantially all of the outermost radial portion maintains a bent orientation.

11. A lid for closing an opening formed on a body of a container comprising:
- an interior surface;
- two or more tabs projecting inwardly from the interior surface and configured to engage a liner disposed and adhered over the opening and between the body of the container and the lid to press an outermost radial portion of the liner so that the outermost radial portion remains substantially flush with a side of the body after removal of the lid from the container.

12. The lid of claim 11, further comprising:
- a cover portion; and
- an annular wall extending axially from the cover portion to form a joint therewith, and
- wherein the tabs protrude inwardly from the joint.

13. The lid of claim 12 defining an axis of rotation, wherein the tabs have a hill-shaped outer surface with a crest and diverging sides, the crest extending generally parallel to the axis of rotation.

14. The lid of claim 12 defining an axis of rotation, wherein the tabs have a generally U-shaped outer surface with a crest and diverging sides, the crest generally extending parallel to the axis of rotation.

15. A method of operating a lid of a container, the method comprising:
- placing a liner within the lid having an interior surface and two or more tabs projecting inwardly from the interior surface;

rotating the lid onto a body of the container while the liner rotates with the lid so that the tabs remain generally rotationally fixed relative to the liner to secure the lid to the body; and bending an outer edge portion of the liner with the tabs as the lid is rotated to remove the lid from the body.

16. The method of claim 15 further comprising indenting the outermost edge of the liner with the tabs while maintaining generally unbent portions of the outermost edge when the lid is fully assembled onto the container.

17. The method of claim 16 wherein the indenting is circumferentially and uniformly spaced around the circumference of the liner.

18. The method of claim 16 wherein the generally unbent portions form a majority of the circumference of the liner.

19. The method of claim 18 wherein the generally unbent portions form approximately about 95% or more of the circumference of the lid.

20. The method of claim 15 further comprising adhering the liner to the container after the lid is mounted on the body.

21. The method of claim 15 wherein bending comprises rotating the tabs to press the tabs against the liner.

22. The method of claim 21 wherein bending comprises creasing the liner.

23. A container comprising:

a body forming an interior and having a sidewall with a distal edge portion forming an opening to the interior;

a liner disposed over the opening, wherein the liner has an inner portion and an outermost radial portion disposed radially outwardly of the distal edge portion of the sidewall; and a lid disposed over the liner and engaging the body, the lid comprising:

an interior surface, and two or more tabs projecting inward from the interior surface, the tabs having a rounded peak in top view, wherein the liner is sized to be releasably rotatably secured within the lid while the lid and liner are initially attached to the body so that the tabs remain generally rotationally fixed relative to the outermost radial portion while being fully assembled to the body, and wherein the tabs are arranged to press the outermost radial portion of the liner while the lid is being removed from the body so that the outermost radial portion maintains a bent orientation.

* * * * *